US010345030B2

(12) United States Patent
Segawa et al.

(10) Patent No.: US 10,345,030 B2
(45) Date of Patent: Jul. 9, 2019

(54) REFRIGERATOR

(71) Applicant: PANASONIC CORPORATION, Osaka (JP)

(72) Inventors: Terutsugu Segawa, Osaka (JP); Toru Okazaki, Osaka (JP)

(73) Assignee: PANASONIC CORPORATION, Osaka (JP)

( * ) Notice: Subject to any disclaimer, the term of this patent is extended or adjusted under 35 U.S.C. 154(b) by 0 days.

(21) Appl. No.: 15/861,997

(22) Filed: Jan. 4, 2018

(65) Prior Publication Data

US 2018/0195792 A1 Jul. 12, 2018

(30) Foreign Application Priority Data

Jan. 6, 2017 (JP) ..... 2017-001233
Oct. 5, 2017 (JP) ..... 2017-195090

(51) Int. Cl.
*F25D 23/02* (2006.01)
*F25D 11/02* (2006.01)
(Continued)

(52) U.S. Cl.
CPC ..... *F25D 23/028* (2013.01); *F25D 11/02* (2013.01); *F25D 23/02* (2013.01); *F25D 23/087* (2013.01);
(Continued)

(58) Field of Classification Search
CPC ..... F25D 23/028; F25D 23/08; F25D 23/082; F25D 23/087; F25D 21/04; F25D 2600/04; F25D 2323/021
See application file for complete search history.

(56) References Cited

U.S. PATENT DOCUMENTS 2,914,819 A * 12/1959 Janos ..... F25D 23/082 292/251.5
3,382,618 A * 5/1968 Townsend ..... F25D 23/087 49/483.1
(Continued)

FOREIGN PATENT DOCUMENTS

DE 1120482 B * 12/1961 ..... F25D 23/087
DE 102007008707 A1 * 8/2008 ..... F25D 23/087
(Continued)

*Primary Examiner* — Andrew M Roersma
(74) *Attorney, Agent, or Firm* — McDermott Will & Emery LLP

(57) ABSTRACT

In a refrigerator capable of suppressing dew condensation in hinged double doors without increasing a caloric value of a heater, a clearance between rotary partition body 109 and a front opening of a refrigerating compartment is thermally insulated by first fin members 206 that are disposed in door gaskets 110, that come into contact with a front surface part of a thermal-insulated box body, or a front surface of division board 303, and rotary partition body, and that includes heat insulating sheets 601 disposed in an inner part for closing a clearance, second fin members 207 that do not come into contact with rotary partition body on a front surface separated from rotary partition body between right and left hinged double doors 102, 103, and heat insulating sheets 601 disposed in first fin members 206, and a high temperature atmosphere is surrounded by second fin members 207.

17 Claims, 18 Drawing Sheets

(51) Int. Cl.
*F25D 23/08* (2006.01)
*F25D 21/04* (2006.01)

(52) U.S. Cl.
CPC ..... *F25D 21/04* (2013.01); *F25D 2323/021* (2013.01); *F25D 2323/024* (2013.01)

(56) References Cited

U.S. PATENT DOCUMENTS

| | | | | |
|---|---|---|---|---|
| 7,008,032 | B2 * | 3/2006 | Chekal | F25D 11/02 312/405 |
| 2006/0035054 | A1 * | 2/2006 | Stepanian | B32B 3/04 428/76 |
| 2008/0209812 | A1 * | 9/2008 | Lancry | F25D 21/04 49/316 |
| 2016/0010249 | A1 * | 1/2016 | Hwang | D04H 1/4291 428/69 |
| 2016/0146528 | A1 * | 5/2016 | Yoon | F25D 23/028 62/277 |

FOREIGN PATENT DOCUMENTS

| | | | |
|---|---|---|---|
| JP | 2003-114087 | A | 4/2003 |
| JP | 2010-249491 | A | 11/2010 |
| JP | 2014-134377 | A | 7/2014 |

* cited by examiner

REFRIGERATOR

CROSS REFERENCE TO RELATED APPLICATIONS

This application is entitled to and claims the benefits of Japanese Patent Application No. 2017-001233, filed on Jan. 6, 2017 and Japanese Patent Application No. 2017-195090, filed on Oct. 5, 2017, the disclosure of which including the specification, drawings and abstract is incorporated herein by reference in its entirety.

TECHNOLOGICAL FIELD

The present invention relates to a refrigerator having right and left hinged double doors that are placed side by side and close a front opening of a storage compartment provided in a body upper part.

BACKGROUND ART

As home large capacity refrigerators, in order to deal with a variety of user needs, refrigerators that are provided with a large number of doors for respective storage compartments with diversification of cooling and storage temperatures are commercialized. Heretofore, a various forms of refrigerators such as a top freezer type refrigerator having a freezing compartment disposed in an upper part, a middle freezer type refrigerator having a freezing compartment disposed between a refrigerating compartment (refrigerating storage compartment) located at an upper part and a vegetable compartment located at a lower part, a bottom freezer type refrigerator having a freezing compartment disposed in an lowermost part, a refrigerator having a longitudinal freezing compartment and a longitudinal vegetable compartment that are placed side by side below a refrigerating compartment located at an upper part, and a side-by-side type refrigerator having a freezing compartment and a refrigerating compartment that are placed side by side on the right and the left have been commercialized.

In such a goods environment, recently, in consideration of usability, as illustrated in FIG. 16, the type of refrigerator 1401, in which refrigerating compartment 1402 having high use frequency and having the largest storage capacity is disposed as hinged double doors at a top stage, ice-making compartment 1403 and temperature switching compartment 1404 are disposed below the refrigerating compartment, and a vegetable compartment (not illustrated) is disposed below the ice-making compartment and the temperature switching compartment, and a freezing compartment (not illustrated) is installed in a lowermost part, is mainstream. On an inner surface on an open end side of one of hinged double doors 1405 of refrigerating compartment 1402, partition body 1406 that turns to the other door when the door is closed is mounted to provide an attraction surface with gaskets 1407. In addition, a heater (not illustrated) is provided inside rotary partition body 1406, so that dew condensation is prevented from occurring on a rotary partition body surface (refer to Japanese Patent Application Laid-Open No. 2010-249491, for example).

Herein, Japanese Patent Application Laid-Open No. 2014-134377 discloses a configuration, in which transfer of heat of a heater disposed in a partition body to the inside of a refrigerator is suppressed, so that heat load to the inside of the refrigerator is reduced, decrease in the temperature of a front surface part of the partition body is suppressed, and input to the heater is reduced while dew condensation is prevented. Specifications of the conventional refrigerator disclosed in Japanese Patent Application Laid-Open No. 2014-134377 will be described with reference to FIG. 17. FIG. 17 is a horizontal sectional view of the vicinity of a rotary partition body part of hinged double doors. Partition body 1501 includes partition plate 1503 that forms a front surface part, and serves as a contact part of gaskets 1502 installed on doors, partition casing 1504 that forms right and left side surface parts and a back surface part, and configures a rectangular parallelepiped outer shell of the partition body 1501 together with partition plate 1503, heater 1505 that serves as a heating section provided behind partition plate 1503, and heat insulating material 1506 that is provided inside partition casing 1504.

Partition casing 1504 is a member that opens forward, and has a U-shaped cross-section, and is formed of a resin material. Partition plate 1503 is formed from an iron plate so as to be magnetized by magnets of gaskets 1502, and the iron plate has excellent thermal conductivity, and therefore dew condensation is prevented by heating of heater 1505. Heater 1505 is formed of heating wires vertically extending at a predetermined interval in the width direction of the partition body 1501, and is adhered to a back surface of partition plate 1503 in a contact state. Heat insulating material 1506 is filled so as to fill up an internal space of the partition body 1501, so that heat by heater 1505 does not pass through the inside of the partition body 1501 and does not transfer to the inside of the refrigerator.

In the above configuration, in both right and left side surface parts 1504A of partition casing 1504, vertically extending slit-like cutouts 1507 are provided. The cutout 1507 is provided at a center in the front-back direction of each of side surface parts 1504A, and divides (isolates) into side surface part front portion 1504A1 on the front side and side surface part back portion 1504A2 on the back side. Consequently, heat of the heater 1505 is suppressed from entering from partition plate 1503 into the refrigerator compartment through partition casing 1504 by heat conduction.

Japanese Patent Application Laid-Open No. 2003-114087 discloses a configuration, in which as a configuration of a partition body, partition bodies are disposed in right and left doors, and the right and left partition bodies are in contact with each other through a gasket, and clearances generated between upper and lower ends of the partition bodies and a refrigerating compartment opening are closed with fin members of gaskets. Specifications of a conventional refrigerator disclosed in Japanese Patent Application Laid-Open No. 2003-114087 will be described with reference to FIG. 18. FIG. 18 is a horizontal sectional view of the vicinity of a rotary partition body part of hinged double doors. As illustrated in FIG. 18, partition bodies 1602*a*, 1602*b* are mounted on side parts of protrusions of door inner plates on the non-pivot sides of left door 1601*a* and right door 1601*b* so as to turnably face by pins 1603*a*, 1603*b*, respectively. Gaskets 1604 are mounted on door back sides, and a space in the refrigerator is closed by bringing left door 1601*a* and right door 1601*b* into contact with respective gaskets 1604 when the doors are closed.

Partition gasket 1605 is mounted on side surface facing left door 1601*a* of partition body 1602*b* so as to vertically extend. Partition gasket 1605 includes a magnet therein, and a side surface, facing the right door 1601*b*, of partition body 1602*a* is provided with an iron plate so as to attract the magnet included in partition gasket 1605.

Flexible fin members 1606*a*, 1606*b* that extend so as to be superposed on each other are provided in the upper and lower ends on the non-pivot sides of respective gaskets 1604 of the right and left hinged double doors so as to face each other. Fin members 1606*a*, 1606*b* suppress entering of heat into the refrigerator.

CITATION LIST

Patent Literature

PTL 1
Japanese Patent Application Laid-Open No. 2010-249491
PTL 2
Japanese Patent Application Laid-Open No. 2014-134377
PTL 3
Japanese Patent Application Laid-Open No. 2003-114087

SUMMARY OF INVENTION

Technical Problem

However, in the conventional configuration disclosed in Japanese Patent Application Laid-Open No. 2014-134377, although it is possible to suppress transfer of heat of the heater (unsigned) to the partition body and entering of the heat into the refrigerator, the clearances generated between the upper and lower ends of the partition body, and the refrigerating compartment opening causes entering of heat into the refrigerating compartment even when the fin members are disposed in the gaskets. Therefore, it is necessary to increase the caloric value of the heater in order to prevent dew condensation due to decrease in the temperature of the fin members.

Additionally, the conventional configuration disclosed in Japanese Patent Application Laid-Open No. 2003-114087 also has a problem that it is necessary to increase the caloric value of the heater in order to prevent dew condensation in the fin members 1606*a*, 1606*b* disposed similarly.

The present invention has been made in order to solve the above conventional problem, and an object of the present invention is to provide a refrigerator capable of suppressing dew condensation in hinged double doors without increasing a caloric value of a heater.

Solution to Problem

To achieve the above object, a refrigerator according to a first aspect of the present invention includes: a division board that divides a thermal-insulated box body into a plurality of rooms including a refrigerating compartment; hinged double doors that are located at a front opening of the refrigerating compartment, and are opened and closed right and left; a rotary partition body that is provided on at least one of inner surfaces of the hinged double doors over a longitudinal direction, and has a partition plate forming an attraction surface; door gaskets that are located between the rotary partition body and the front opening, and attract the attraction surface; and a thermal-insulated box body front surface heating section that heats a front surface part of the thermal-insulated box body and a front surface of the division board, the refrigerator further includes: first fin members disposed in the door gaskets, the first fin members coming into contact with the front surface part of the thermal-insulated box body, the front surface of the division board, and the rotary partition body, the first fin members closing a clearance between the rotary partition body and the front opening of the refrigerating compartment; and second fin members disposed at portions of the door gaskets, the portions being not deformed when the hinged double doors are opened and closed, the second fin members disposed at a clearance between the right and left hinged double doors on a front surface of the rotary partition body, the second fin members not coming into contact with the rotary partition body and not coming into contact with each other.

The refrigerator according to a second aspect of the present invention is the refrigerator according to the first aspect, in which the portions of the door gasket, the portions not being deformed and being disposed with the second fin members, are portions for fixing the attraction surface, and magnetic substances disposed inside the door gaskets so as to attract the door gaskets.

The refrigerator according to a third aspect of the present invention is the refrigerator according to the first aspect, in which the portions of the door gasket, the portions not being deformed and being disposed with the second fin members, are fixation fin parts that fix the door gasket to the hinged double doors in a contact manner.

The refrigerator according to a fourth aspect of the present invention is the refrigerator according to the first aspect, in which at least two or more of the second fin members are provided in each of the right and left door gaskets.

The refrigerator according to a fifth aspect of the present invention is the refrigerator according to the fourth aspect, in which at least the two or more of second fin members that are provided in each of the right and left door gaskets do not come into contact with each other.

The refrigerator according to a sixth aspect of the present invention is the refrigerator according to the first aspect, on which the second fin members are provided over a whole longitudinal direction of the hinged double doors.

The refrigerator according to a seventh aspect of the present invention is the refrigerator according to the first aspect, in which the second fin members are provided so as to be separated on upper end sides and lower end sides of the hinged double doors.

The refrigerator according to an eighth aspect of the present invention is the refrigerator according to the first aspect, in which the second fin members are provided on upper end sides of the hinged double doors.

The refrigerator according to a ninth aspect of the present invention is the refrigerator according to the first aspect, in which the second fin members are provided on lower end sides of the hinged double doors.

The refrigerator according to a tenth aspect of the present invention is the refrigerator according to the first aspect, in which the second fin members extend in a horizontal direction in upper parts of the hinged double doors.

The refrigerator according to an eleventh aspect of the present invention is the refrigerator according to the tenth aspect, in which extending parts of the second fin members, the extending parts extending to the upper parts of the hinged double doors, are bent toward the front surface part of the thermal-insulated box body.

The refrigerator according to a twelfth aspect of the present invention is the refrigerator according to the eleventh aspect, in which a structure, in which the second fin members are bent, allows contact with the front surface part of the thermal-insulated box body.

The refrigerator according to a thirteenth aspect of the present invention is the refrigerator according to the first aspect, in which the second fin members extend in a horizontal direction in lower parts of the hinged double doors.

The refrigerator according to a fourteenth aspect of the present invention is the refrigerator according to the thirteenth aspect, in which extending parts of the second fin member, the extending parts extending to the lower parts of the hinged double doors, are bent toward the front surface of the division board.

The refrigerator according to a fifteenth aspect of the present invention is the refrigerator according to the fourteenth aspect, in which the bent structures of the second fin members allow contact with the front surface of the division board.

The refrigerator according to a sixteenth aspect of the present invention is the refrigerator according to the first aspect, in which sheet-like heat insulating materials are disposed on refrigerator-inside outer surfaces of the first fin members.

The refrigerator according to a seventeenth aspect of the present invention is the refrigerator according to the first aspect, in which sheet-like heat insulating materials are disposed on outside air side outer surfaces of the first fin members.

The refrigerator according to an eighteenth aspect of the present invention is the refrigerator according to the first aspect, in which sheet-like heat insulating materials are disposed inside the first fin members.

The refrigerator according to a nineteenth aspect of the present invention is the refrigerator according to the eighteenth aspect, in which the sheet-like heat insulating materials each are a heat insulating sheet obtained by burying silica aerogel in gaps of a fiber sheet.

The refrigerator according to a twentieth aspect of the present invention is the refrigerator according to the first aspect, in which the rotary partition body further has: a heat insulating material that is disposed inside the rotary partition body; a partition frame body that covers a peripheral edge of the partition plate, and an outer surface of the heat insulating material; and a partition plate heating section that heats an inner surface of the partition plate.

With this configuration, it is possible to suppress a decrease in the temperature of the fin members of the hinged double doors without increasing a caloric value of a heater.

Advantageous Effects of Invention

As described above, according to a refrigerator of the present invention, it is possible to suppress dew condensation in hinged double doors, and reduce heater power consumption.

DESCRIPTION OF EMBODIMENTS

Hereinafter, one or more embodiments of the present invention will be described with reference to the accompanying drawings. However, the scope of the invention is not limited to the disclosed embodiments.

Embodiment 1

Embodiment 1 of the present invention will be described with reference to FIG. 1 to FIG. 6.

<Whole Configuration>

Figure 1:
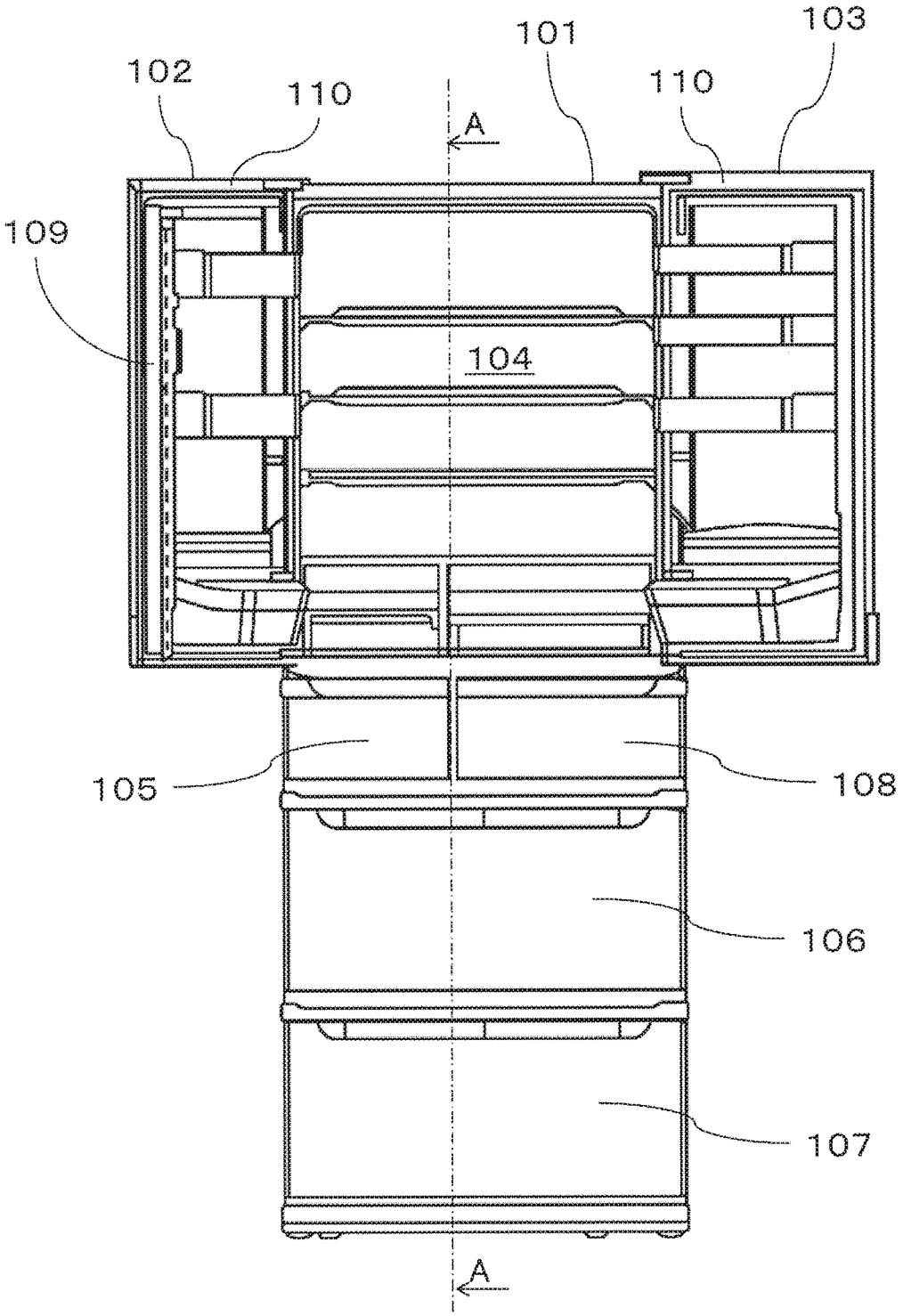
FIG. 1 is a front view of a refrigerator according to Embodiment 1 of the present invention.

FIG. 1 is a front view of refrigerator 101 according to Embodiment 1 of the present invention. In the following description, the vertical direction in FIG. 1 is referred to as the "longitudinal direction", and the upward direction and the downward direction are referred to as the "upper side" and the "lower side", respectively. Additionally, the right and left direction in FIG. 1 is referred to as the "width direction" or the "horizontal direction", and the right direction and the left direction are referred to as the "right side" and the "left side", respectively. Additionally, the direction perpendicular to the paper in FIG. 1 is referred to as the front-back direction, the forward direction, and the backward direction are referred to as the "front side" or the "outside air side", and the "refrigerator inside", respectively. The hinged double doors of refrigerator 101 have left door 102 located on the observers' left side, and right door 103 located on the observers' right side. Herein, the hinged double doors are a pair of doors that opens and closes right and left. FIG. 1 illustrates a state where left door 102 and right door 103 are opened. Portions where left door 102 and right door 103 are provided correspond to a portion of refrigerating storage compartment 104, ice-making compartment 105 is provided at a portion under left door 102, and freezing storage compartment 106 and vegetable compartment 107 are provided on the lower side below ice-making compartment. Switching compartment 108 is provided on the lower side of right door 103 and on the right side of ice-making compartment 105. Left door 102 and right door 103 are pivoted on respective hinge sections, so that the left door and the right door are opened. Rotary partition body 109 is provided on the non-pivot side of left door 102.

<Rotary Partition Body 109>

Rotary partition body 109 rotates in accordance with opening and closing operation of left door 102, the non-pivot sides of left door 102 and right door 103 are closed through door gaskets 110 in a state where the doors are closed, so that leakage of cooling air from refrigerating storage compartment 104 is prevented.

Figure 2:
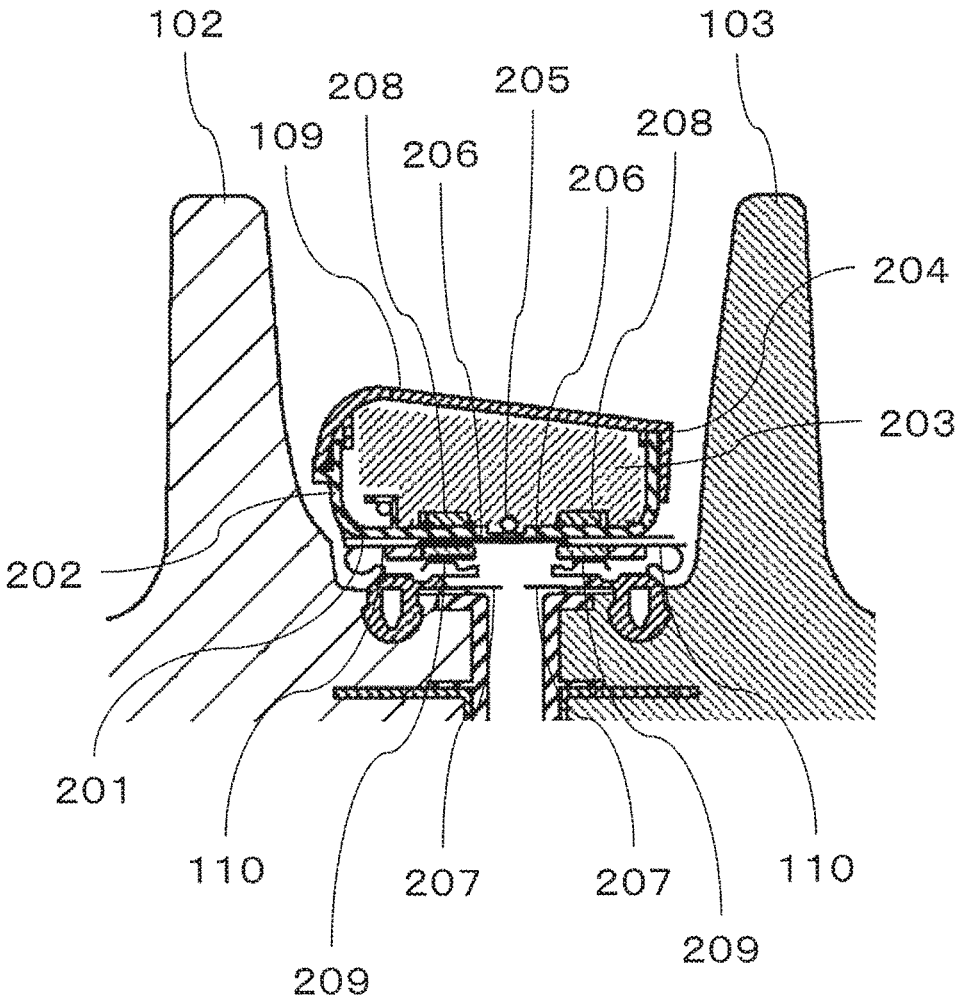
FIG. 2 is a horizontal sectional view of hinged double doors according to Embodiment 1 of the present invention.

FIG. 2 is a horizontal sectional view of hinged double doors according to Embodiment 1 of the present invention. In FIG. 2, rotary partition body 109 includes partition plate 202 that forms attraction surface 201 to door gaskets 110, heat insulating material 203 that is disposed in rotary partition body 109, and is made of styrene foam, partition frame body 204 that covers a peripheral edge of partition plate 202 and an outer surface of heat insulating material 203, and is made of synthetic resin, and a partition body heating section 205 disposed at the center of an inner surface of partition plate 202.

<Door Gaskets 110>

In door gaskets 110, first fin members 206 are disposed so as to increase the contact area with attraction surface 201, and block a clearance (refer to FIG. 3) generated between a vertical upper end of rotary partition body 109, and a vertical lower surface of refrigerator box body upper wall 302, and a clearance (refer to FIG. 3) generated between a vertical lower end of rotary partition body 109 and an upper surface in the vertical direction of division board front surface plate 303. Respective first fin members 206 are provided on left door 102 and right door 103, and are disposed so as to come into contact with each other. Additionally, in door gaskets 110, second fin members 207 are disposed at positions on the front side separated from rotary partition body 109 (downward direction in FIG. 2). Second fin members 207 are disposed so as not come into contact with rotary partition body 109.

Herein, partition plate 202 is synthetic resin, and is mounted with two magnetic substances 208 on an inner surface. Magnetic substances 208 are each formed in a substantially whole high region of rotary partition body 109 in the height direction of refrigerator 101. Magnetic substances 208 are disposed so as to face magnetic substances 209 formed in door gaskets 110 in a state where left door 102 and right door 103 are closed, and rectangular parallelepiped plastic magnets are used in this embodiment.

Partition body heating section 205 is a linear component such as a linear heater, and is disposed in parallel with magnetic substances 208 between magnetic substances 208.

Figure 3:
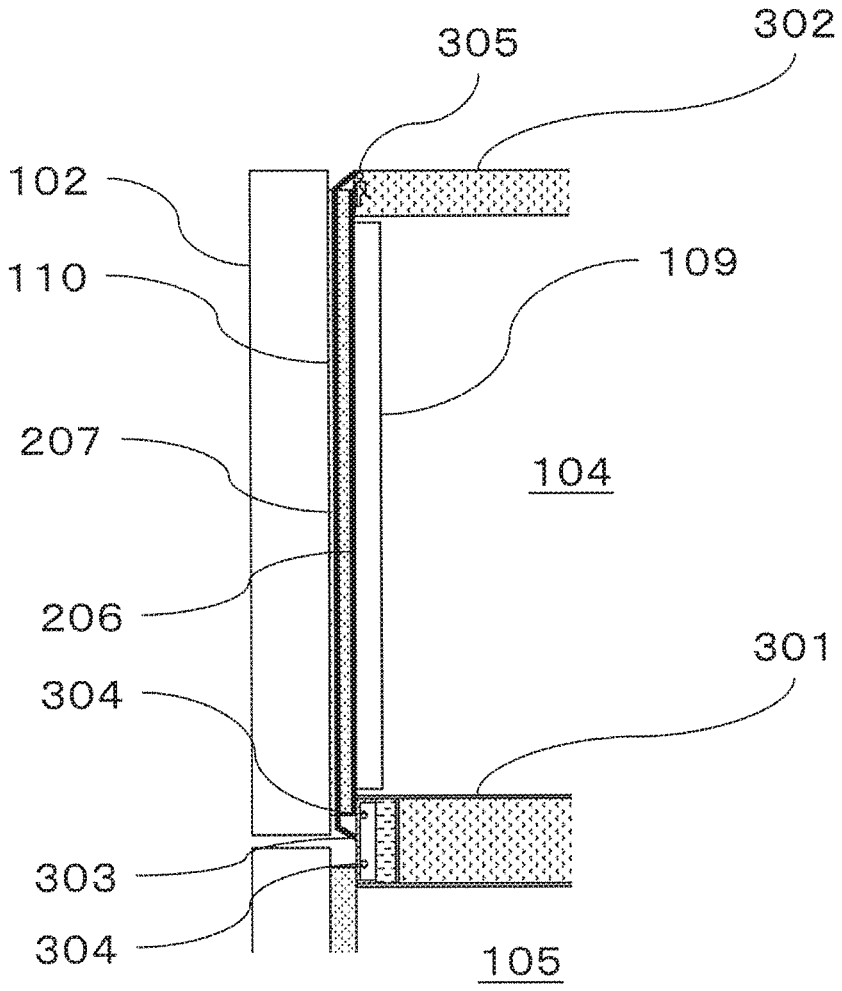
FIG. 3 is an A-A sectional view in FIG. 1 illustrating the state of closing of the hinged double doors of the refrigerator according to Embodiment 1 of the present invention.

FIG. 3 is an A-A sectional view in FIG. 1 illustrating the state of closing of the hinged double doors of refrigerator 101 according to Embodiment 1 of the present invention. A lower part and an upper part of refrigerating storage compartment 104 are surrounded by division board 301 and refrigerator box body upper wall 302, respectively. Division board front surface plate 303 is disposed on a front surface of division board 301, and divided front surface part heating sections 304 are disposed on a back surface of the division board front surface plate. Additionally, box body upper wall front surface heating section 305 that heats a front surface part of refrigerator box body upper wall 302 is disposed. Additionally, first fin members 206 and second fin members 207 are disposed in door gaskets 110.

Figure 4:
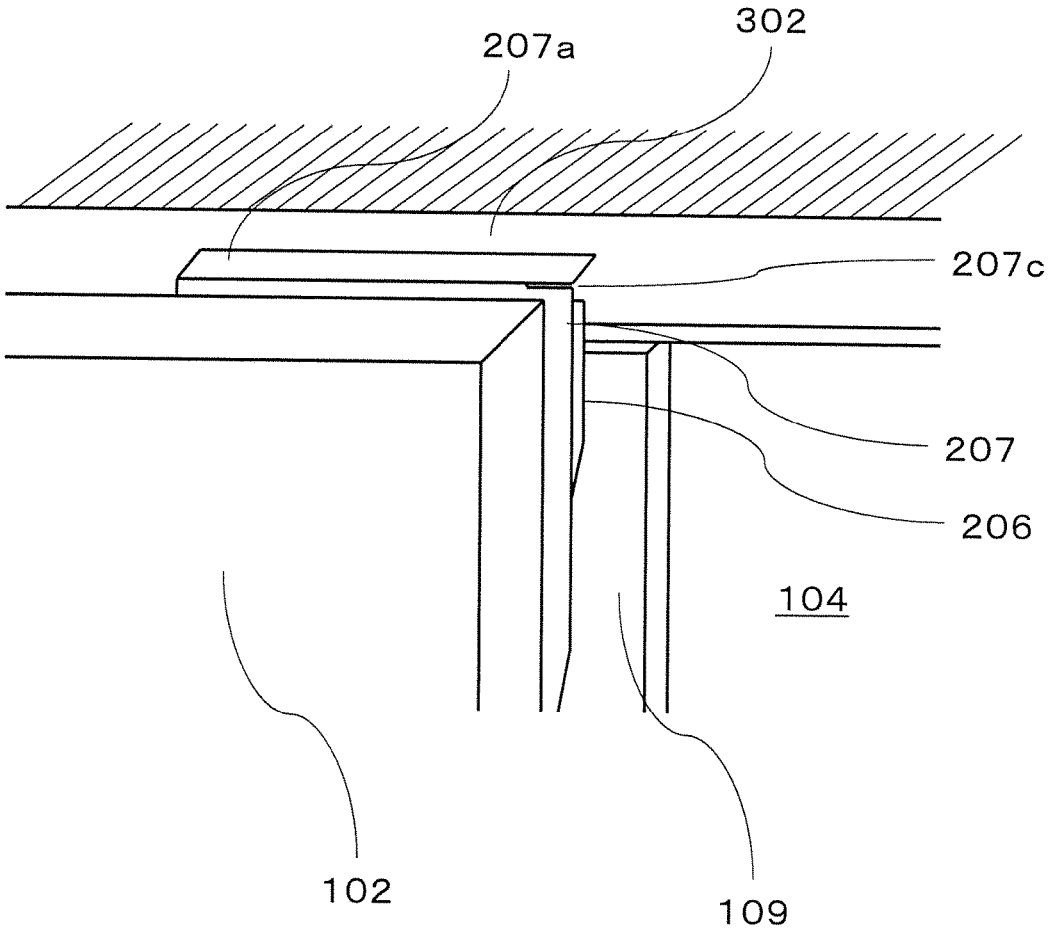
FIG. 4 is a perspective view of an upper part of the hinged double doors at the time of opening of a right door of the refrigerator according to Embodiment 1 of the present invention.
Figure 5:
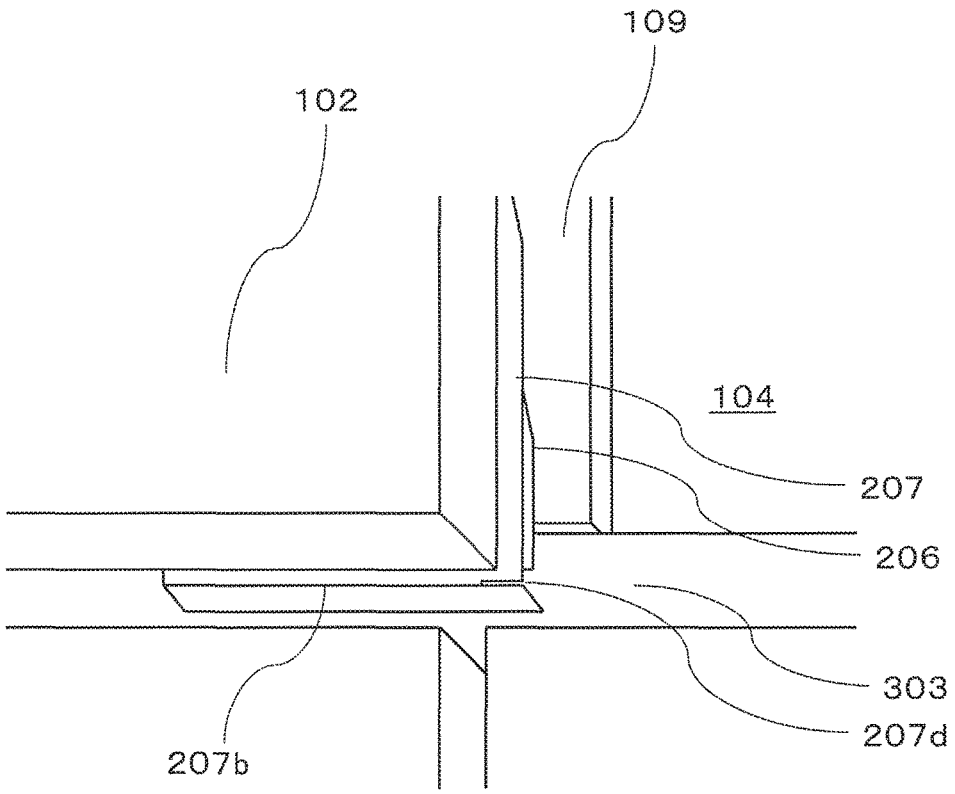
FIG. 5 is a perspective view of a lower part of the hinged double doors at the time of opening f the right door of the refrigerator according to Embodiment 1 of the present invention.

FIG. 4 is a perspective view of an upper part of the hinged double doors according to Embodiment 1 of the present invention, and FIG. 5 is a perspective view of a lower part of the hinged double doors according to Embodiment 1 of the present invention. First fin members 206 come into contact with a front surface of rotary partition body 109, a front surface of division board front surface plate 303 (refer to FIG. 3), and a front surface of refrigerator box body upper wall 302 to close refrigerating storage compartment 104. Additionally, a vertical upper end of second fin member 207 has an extending part extending in the width direction (horizontal direction) in the upper part of each of the hinged double doors. Additionally, a vertical lower end of second fin member 207 has an extending part extending in the width direction (horizontal direction) in the lower part of each of the hinged double doors. The extending parts of second fin members 207 have upper bent parts 207*a* (refer to FIG. 4) that are bent toward the front surface of refrigerator box body upper wall 302 and come into contact with the front surface of refrigerator box body upper wall 302. Additionally, the extending parts of second fin members 207 have lower bent parts 207*b* (refer to FIG. 5) that are bent toward division board front surface plate 303 and come into contact with division board front surface plate 303.

Additionally, upper bent parts 207*a* and lower bent parts 207*b* of second fin members 207 form cutouts, and facilitate deformation of the bent parts at the time of contact with the front surface of refrigerator box body upper wall 302, so that there is no effect of first fin members 206 on sealability between rotary partition body 109, division board front surface plate 303 and refrigerator box body upper wall 302, and left door 102.

Figures 6A, 6B:
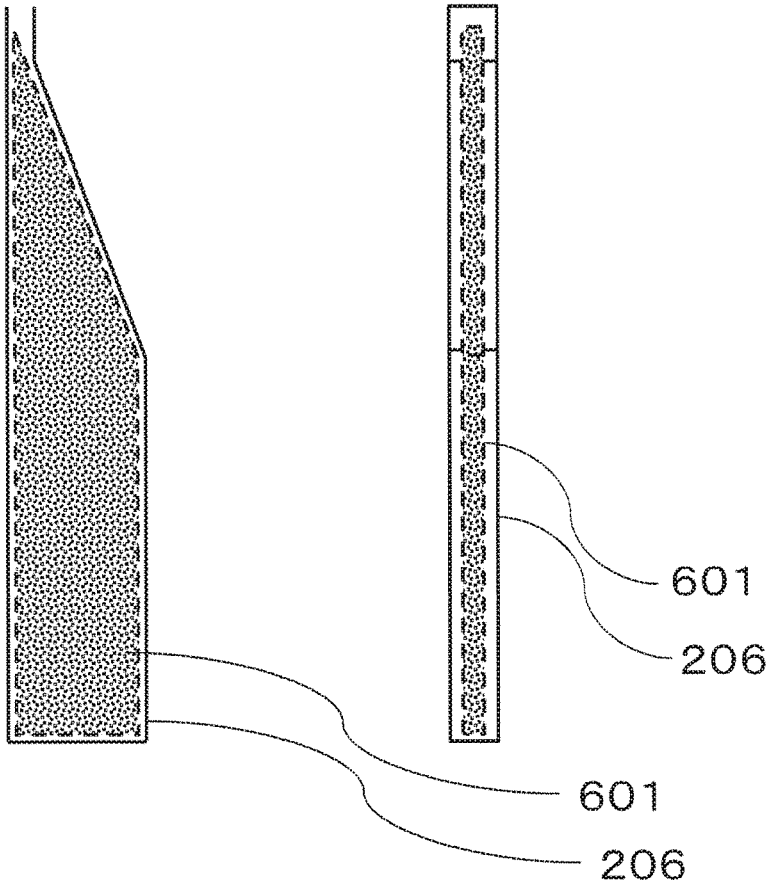
FIG. 6A is an enlarged front view of a lower part of a first fin member according to Embodiment 1 of the present invention.
FIG. 6B is an enlarged right side view of the lower part of the first fin member according to Embodiment 1 of the present invention.

FIGS. 6A and 6B each are an enlarged view of a lower part of first fin members 206 according to Embodiment 1 of the present invention, in which FIG. 6A is a front view, and FIG. 6B is a right side view. Sheet-like heat insulating material 601 illustrated in FIG. 6A has substantially the same shape as each of first fin members 206. As illustrated in FIG. 6B, sheet-like heat insulating material 601 is disposed inside a lower end of each of first fin members 206. This sheet-like heat insulating material is sometimes referred to as a heat insulating sheet. Additionally, sheet-like heat insulating material 601 is disposed also inside an upper end of each of first fin members 206 (not illustrated), similarly. As each sheet-like heat insulating material 601, a sheet-like flexible heat insulating material obtained by burying silica aerogel in gaps of a fiber sheet is used. However, other flexible heat insulating material may be used.

Herein, in this Embodiment 1, upper bent parts 207*a* of second fin members 207 come into contact with the front surface of refrigerator box body upper wall 302, and lower bent parts 207*b* of second fin members 207 come into contact with division board front surface plate 303. However, a non-contact structure may be employed. Consequently, reduction in force for closing refrigerating storage compartment 104 caused by first fin members 206 due to such contact that causes deformation of door gaskets 110 can be suppressed by the non-contact structure.

Additionally, the vertical upper ends and the vertical lower ends of second fin members 207 are bent, but may not be bent. Although, as illustrated in FIG. 4 and FIG. 5, cutouts 207*c*, 207*d* are formed in upper and lower bent parts 207*a*, 207*b* of second fin members 207, respectively, deformation may be facilitated depending on the thickness or the material of each second fin member, so that cutouts 207*c*, 207*d* can be eliminated.

In this Embodiment 1, the widths of second fin members 207 are narrowed at central portions in the vertical direction. This is because force necessary for opening and closing the doors due to contact between the second fin members is reduced. In a case where an effect on the opening and closing force is small, the widths of second fin members 207 may be the same in the vertical direction. Additionally, heat insulating sheets 601 have substantially the same shape as first fin members 206, but the shapes of heat insulating sheets 601 when heat insulating sheets 601 are disposed in first fin members 206 are not limited to the above shapes, and may be, for example, rectangles.

<State of Peripheral Part of Refrigerating Storage Compartment During Cooling Operation>

A state of a peripheral part of refrigerating storage compartment 104 during cooling operation in this Embodiment 1 will be described with reference to FIG. 3 to FIG. 6B. The temperature of the inside of refrigerating storage compartment 104 is controlled to be lower than the peripheral outside air temperature of refrigerator 101 by cooling operation. When the temperature of a surface of refrigerator 101 lowers, and the surface temperature becomes at most a dew point of the outside air, dew condensation occurs. Therefore, the temperature of a surface in contact with the outside air of refrigerator 101 is maintained at at least the dew point temperature of the outside air by a section that heats the surface of refrigerator 101, including partition body heating section 205, front surface part heating section 304, box body upper wall front surface heating section 305 for prevention of dew condensation.

Herein, a clearance between rotary partition body 109 and division board 301, and a clearance between rotary partition body 109 and refrigerator box body upper wall 302 are set in design in order to prevent failure in opening and closing left door 102 due to contact. Therefore, first fin members 206 closes the clearances, so that entering of the outside air into refrigerating storage compartment 104 is prevented. First fin members 206 located at portions of these clearances are directly cooled by low temperature cooling air of refrigerating storage compartment 104, and therefore become the lowest temperatures compared to other portions of first fin members 206, and become places where dew condensation is likely to occur. Therefore, the coolest places of first fin members 206 need to be heated to the dew point or more by partition body heating section 205. In this Embodiment 1, heat insulating sheets 601 (refer to FIG. 6A and FIG. 6B) are disposed inside first fin members 206, so that decrease in the surface temperatures of first fin members 206 is suppressed.

Additionally, division board front surface plate 303 and front surface of refrigerator box body upper wall 302 are heated to the outside air temperature or more by front surface part heating section 304 and box body upper wall front surface heating section 305, respectively, an atmosphere heated at the dew point or more of this vicinity is partitioned from other outside air by second fin members 207, so that the atmosphere temperatures of the vicinities of the surfaces of first fin members 206 in the clearance part between rotary partition body 109 and division board 301, and the atmosphere temperatures of the vicinities of the surfaces of first fin members 206 in the clearance part between rotary partition body 109 and refrigerator box body upper wall 302 are increased, so that the surface temperatures of first fin members 206 can be increased compared to a case where second fin members 207 do not exist.

As described above, according to the configuration of this Embodiment 1, thermal insulation is attained by heat insulating sheets 601 disposed inside first fin members 206, and a high temperature atmosphere is surrounded by second fin members 207, so that it is possible to reduce supplying power for heater heating by partition body heating section 205 installed in rotary partition body 109, and it is possible to reduce power consumption.

Embodiment 2

Embodiment 2 of the present invention will be described with reference to FIG. 7, FIG. 8 and FIG. 9. Components of Embodiment 2 of the present invention are the same as the components illustrated in FIG. 1, FIG. 2, FIG. 6A and FIG. 6B in Embodiment 1. Additionally, a state of a peripheral part of a refrigerating storage compartment during cooling operation in Embodiment 2 is the same as those in Embodiment 1. Hereinafter, components of Embodiment 2 different from the components of Embodiment 1 will be mainly described, and components of Embodiment 2 identical to the components of Embodiment 1 are denoted by the same reference numerals, and description thereof will be omitted.

Figure 7:
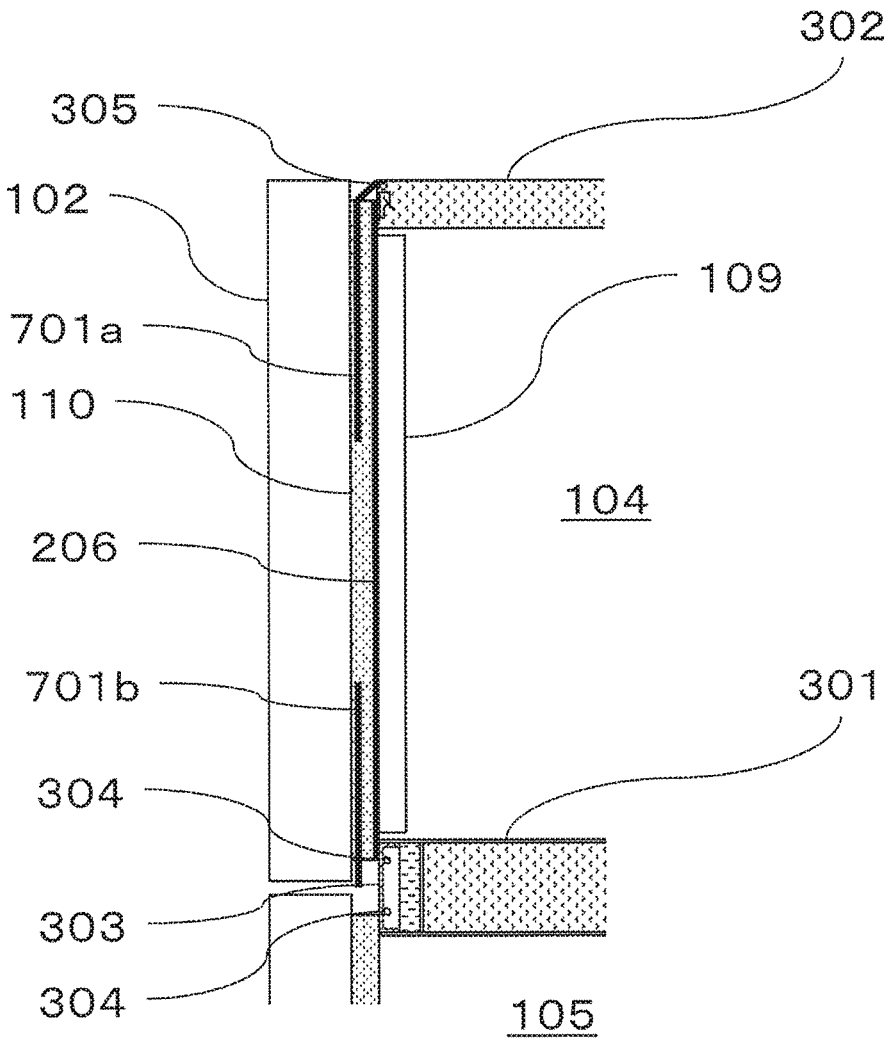
FIG. 7 is a longitudinal sectional view illustrating the state of closing of hinged double doors of a refrigerator according to Embodiment 2 of the present invention.

FIG. 7 is a longitudinal sectional view illustrating the state of closing of hinged double doors of refrigerator 101 according to Embodiment 2 of the present invention. Each of first fin members 206 is disposed in door gasket 110. Additionally, upper second fin member 701*a* and lower second fin member 701*b* are disposed in each of door gaskets 110 so as to be divided on an upper side and a lower side.

Figure 8:
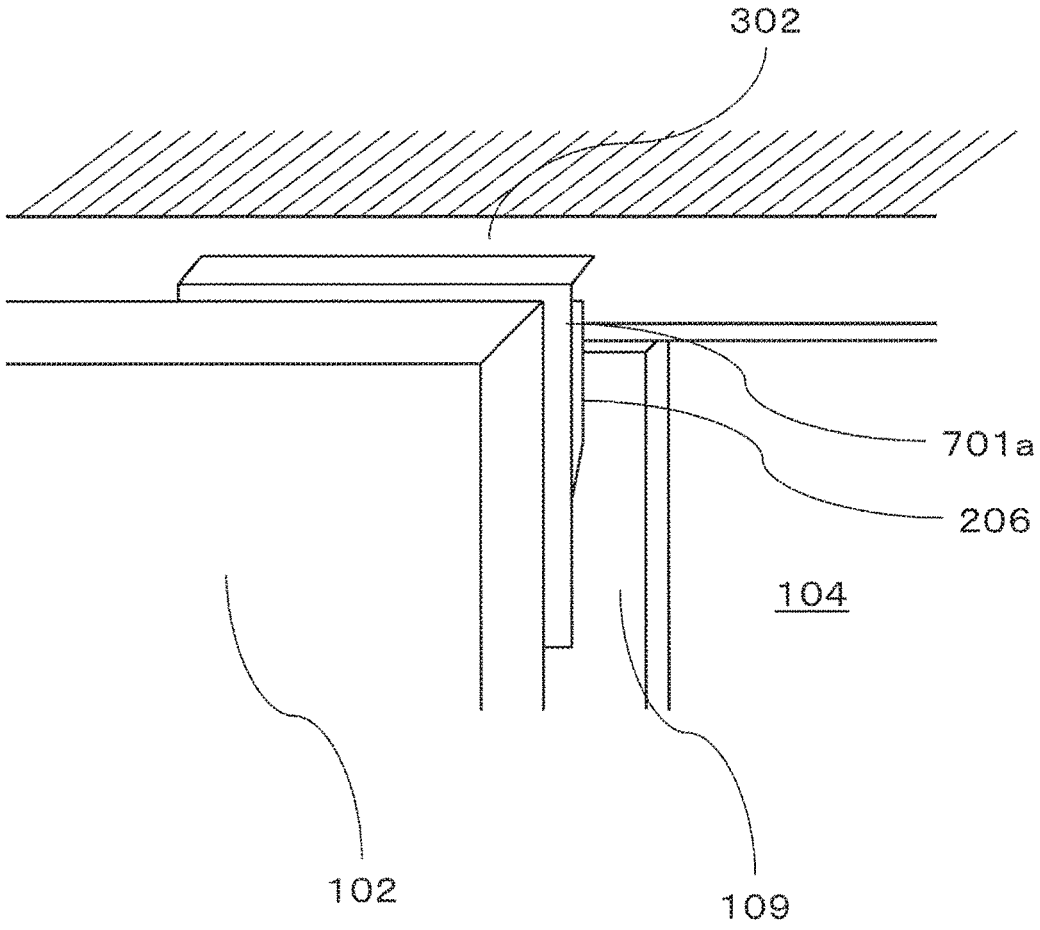
FIG. 8 is a perspective view of an upper part of the hinged double doors at the time of opening of a right door of the refrigerator according to Embodiment 2 of the present invention.
Figure 9:
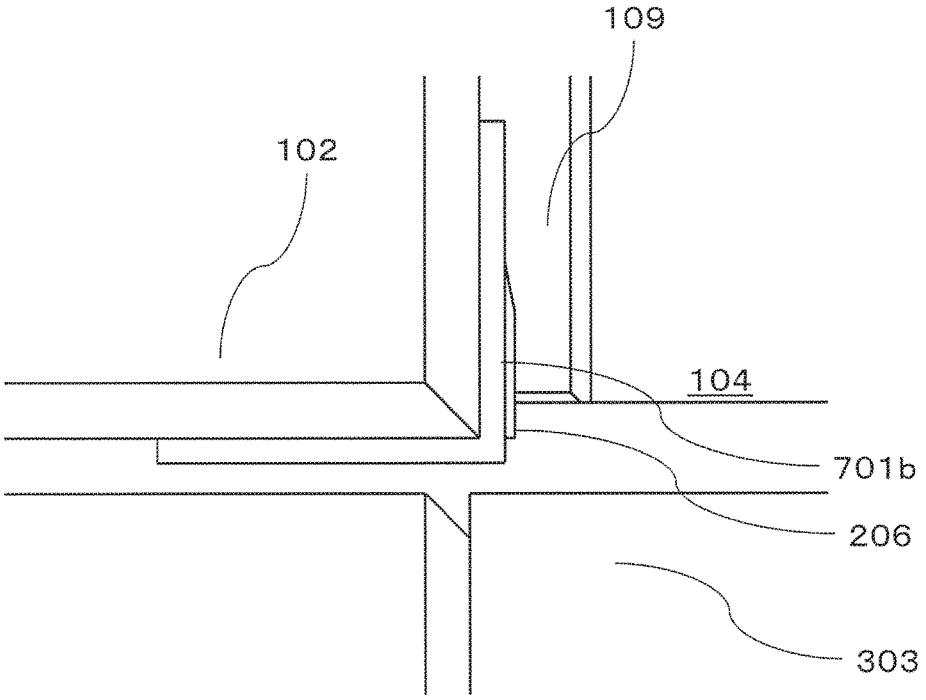
FIG. 9 is a perspective view of a lower part of the hinged double doors at the time of opening of the right door of the refrigerator according to Embodiment 2 of the present invention.

FIG. 8 is a perspective view of an upper part of hinged double doors at the time of opening of right door 103 of refrigerator 101 according to Embodiment 2 of the present invention. FIG. 9 is a perspective view of a lower part of the hinged double doors at the time of opening of right door 103 of refrigerator 101 according to Embodiment 2 of the present invention. First fin members 206 come into contact with a front surface of rotary partition body 109, a front surface of division board front surface plate 303, and a front surface of refrigerator box body upper wall 302 to close refrigerating storage compartment 104. Each of upper second fin members 701*a* is bent to come into contact with a front surface of refrigerator box body upper wall 302. Each of lower second fin members 701*b* is not bent (refer to FIG. 7).

Herein, each second fin member has a tip that comes into contact with the front surface of refrigerator box body upper wall 302, and division board front surface plate 303. However, a non-contact configuration may be employed in order to suppress reduction in force for closing refrigerating storage compartment 104 by first fin members 206 due to contact that causes deformation of door gaskets 110. Additionally, upper second fin members 701*a* each have a structure in which an upper end is bent, but each may have a structure in which an upper end is not bent. Additionally, bent parts of upper second fin members 701*a* are not provided with cutout shapes. However, the bent parts of upper second fin members 701*a* may be formed with cutouts, and deformation of the bent parts may be facilitated when the bent part comes into contact with the second fin member (not illustrated) disposed in door gasket 110 of right door 103 at the time of closing right door 103. Similarly, lower second fin members 701*b* do not have bent parts. However, bent parts may be disposed, and may come into contact with division board front surface plate 303.

As described above, according to the configuration of this Embodiment 2, thermal insulation is attained by heat insulating sheets 601 disposed inside first fin members 206, and a high temperature atmosphere is surrounded by upper second fin members 701*a* and lower second fin members 701*b*, so that it is possible to reduce supplying power for heater heating by partition body heating section 205 installed in rotary partition body 109, and it is possible to reduce power consumption.

Embodiment 3

Embodiment 3 of the present invention will be described with reference to FIG. 10. Components of Embodiment 3 of the present invention are the same as the components illustrated in FIG. 1, FIG. 2, FIG. 6A, FIG. 6B and FIG. 7 in Embodiment 2. Additionally, a state of a peripheral part of refrigerating storage compartment 104 during cooling operation in Embodiment 3 is the same as those in Embodiment 2. Hereinafter, components of Embodiment 3 different from the components of Embodiment 2 will be mainly described, and components of Embodiment 3 identical to the components of Embodiment 2 are denoted by the same reference numerals, and description thereof will be omitted.

Figure 10:
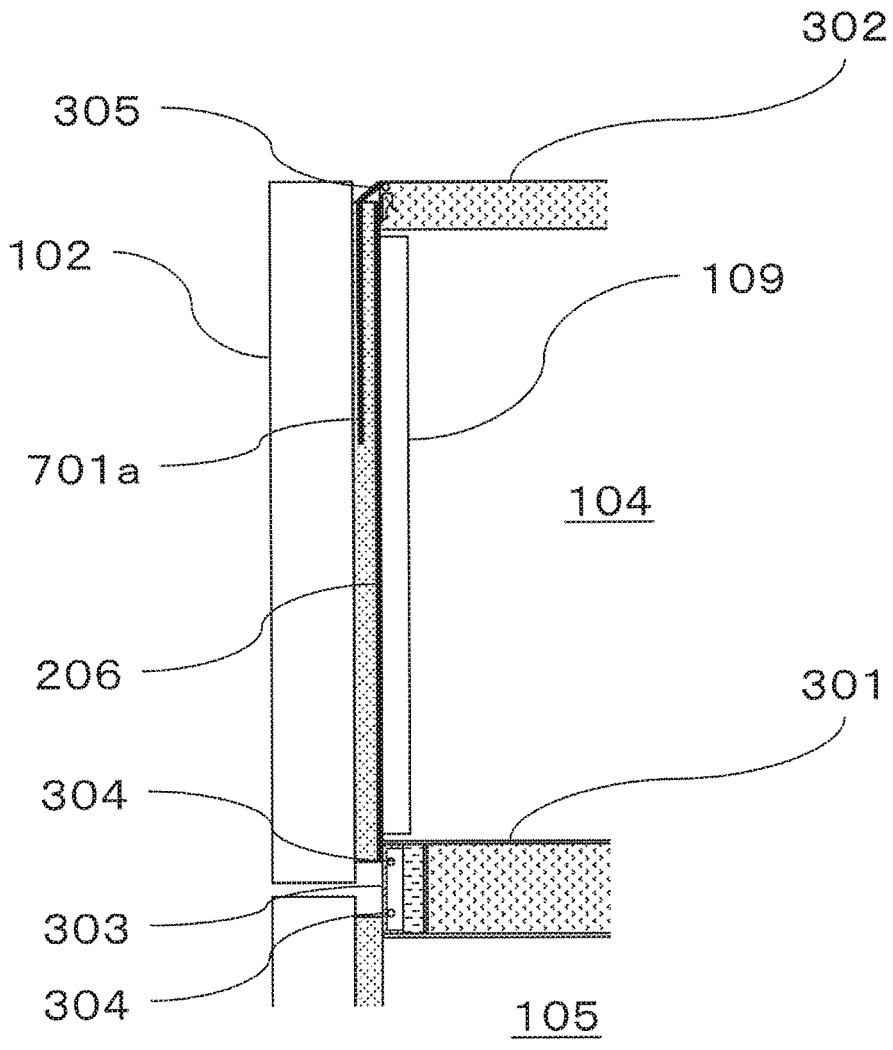
FIG. 10 is a horizontal sectional view of hinged double doors of a refrigerator according to Embodiment 3 of the present invention.

FIG. 10 is a horizontal sectional view of hinged double doors according to Embodiment 3 of the present invention. First fin members 206 are disposed in door gaskets 110, second fin members 701*a* are disposed in upper ends of door gaskets 110, first fin members 206 come into contact with a front surface of rotary partition body 109, a front surface of division board front surface plate 303, and a front surface of refrigerator box body upper wall 302 to close refrigerating storage compartment 104. Upper second fin members 701*a* have respective upper ends that are bent, and come into contact with a front surface of refrigerator box body upper wall 302.

Herein, in this Embodiment 3, bent parts of upper second fin members 701*a* are not provided with cutout shapes. However, the bent parts of upper second fin members 701*a* may be formed with cutouts, and deformation of the bent parts may be facilitated when the bent part comes into contact with the second fin member (not illustrated) disposed in door gasket 110 of right door 103 at the time of closing right door 103.

As described above, according to this Embodiment 3, thermal insulation is attained by heat insulating sheets 601 disposed inside first fin members 206, and a high temperature atmosphere is surrounded by second fin members 701*a*, so that it is possible to reduce supplying power for heater heating by partition body heating section 205 installed in rotary partition body 109, and it is possible to reduce power consumption.

Embodiment 4

Embodiment 4 of the present invention will be described with reference to FIG. 11 and FIG. 12. Components of Embodiment 4 of the present invention are the same as the components illustrated in FIG. 1, FIG. 2, and FIG. 9 in Embodiment 2. Additionally, a state of a peripheral part of refrigerating storage compartment 104 during cooling operation in Embodiment 4 is the same as those in Embodiment 2. Hereinafter, components of Embodiment 4 different from the components of Embodiment 2 will be mainly described, and components of Embodiment 4 identical to the components of Embodiment 2 are denoted by the same reference numerals, and description thereof will be omitted.

Figure 11:
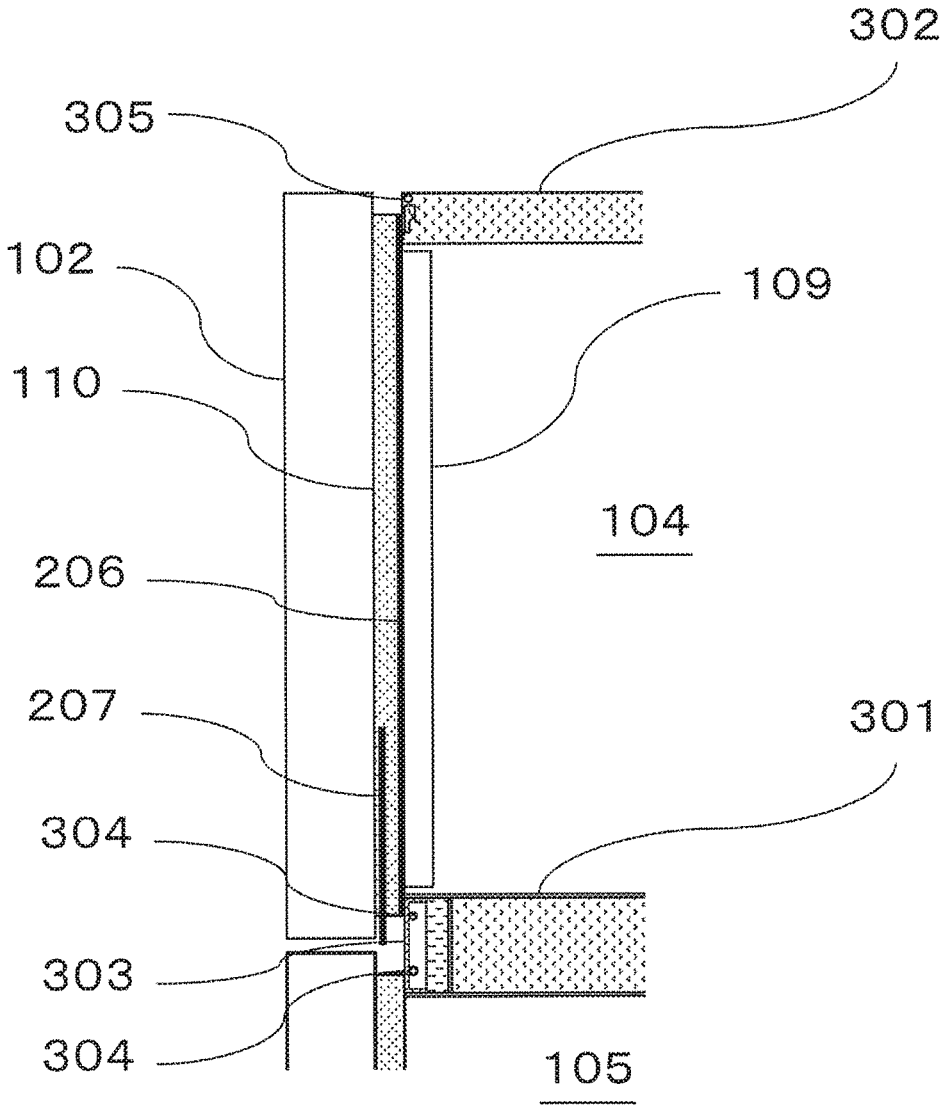
FIG. 11 is a longitudinal sectional view illustrating the state of closing of hinged double doors of a refrigerator according to Embodiment 4 of the present invention.

FIG. 11 is a longitudinal sectional view illustrating the state of closing the hinged double doors of refrigerator 101 according to Embodiment 4 of the present invention. First fin members 206 are disposed in door gaskets 110, and respective second fin members 207 are disposed so as to be fixed to left door 102 and right door 103. First fin members 206 come into contact with a front surface of rotary partition body 109, a front surface of division board front surface plate 303, and a front surface of refrigerator box body upper wall 302 to close refrigerating storage compartment 104.

Figures 12A, 12B:
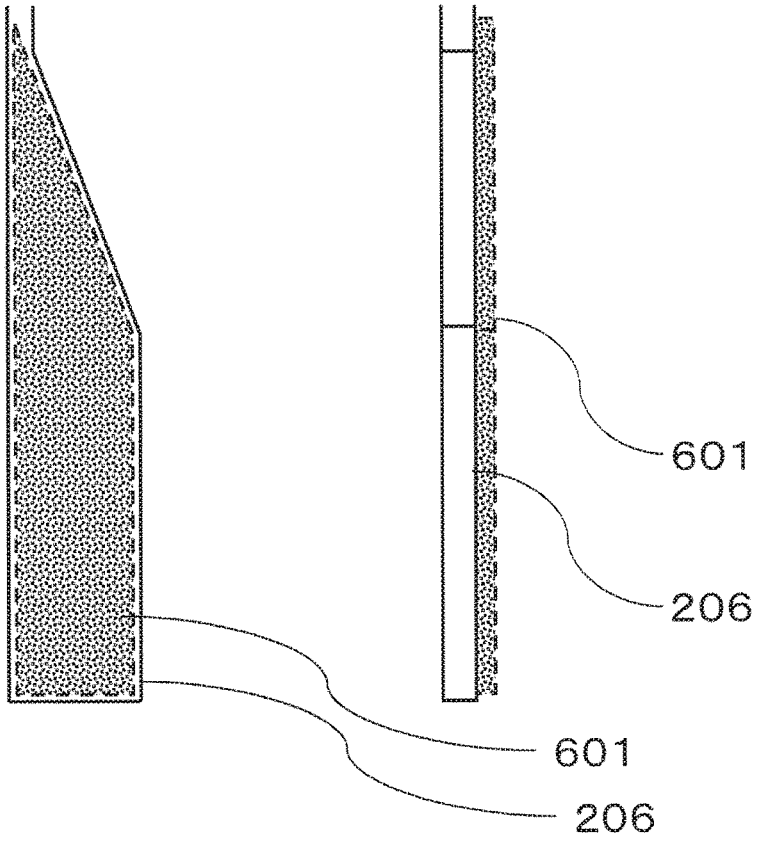
FIG. 12A is an enlarged front view of a lower part of a first fin member according to Embodiment 4 of the present invention.
FIG. 12B is an enlarged right side view of the lower part of the first fin member according to Embodiment 4 of the present invention.

FIG. 12A is an enlarged front view of a lower part of a first fin member according to Embodiment 4 of the present invention. FIG. 12B is an enlarged right side view of a lower part of a first fin member according to Embodiment 4 of the present invention. Sheet-like heat insulating material 601 has substantially the same shape as each of first fin members 206. As illustrated in FIG. 12B, sheet-like heat insulating material 601 is disposed on a refrigerator-inside outer surface of each of first fin members 206. As each sheet-like heat insulating material 601, a sheet-like flexible heat insulating material obtained by burying silica aerogel in gaps of a fiber sheet is used. However, other flexible heat insulating material may be used.

Herein, in this Embodiment 4, second fin members 207 do not have bent parts. However, bent parts may be disposed, and come into contact with division board front surface plate 303. Respective lower ends of first fin members 206 are disposed inside sheet-like heat insulating materials 601. Similarly, respective upper ends of the first fin members are disposed inside sheet-like heat insulating materials 601 (not illustrated). As each sheet-like heat insulating material 601, a sheet-like flexible heat insulating material 211 obtained by burying silica aerogel in gaps of a fiber sheet is used. However, other flexible heat insulating material may be used. Additionally, in this Embodiment 4, sheet-like heat insulating material 601 is disposed on a refrigerator-inside outer surface of each of first fin members 206. However, sheet-like heat insulating material 601 may be disposed on an outside air side outer surface of each of first fin members 206. Additionally, heat insulating sheets 601 have substantially the same shape as first fin members 206. However, as long as each sheet-like heat insulating material 601 is within the outer shape dimension of first fin member 206, the shape of sheet-like heat insulating material 601 is not limited to the above shape, and may be, for example, a rectangle.

As described above, according to this Embodiment 4, thermal insulation is attained by heat insulating sheets 601 disposed inside first fin members 206, and a high temperature atmosphere is surrounded by second fin members 207, so that it is possible to reduce supplying power for heater heating by partition body heating section 205 installed in rotary partition body 109, and it is possible to reduce power consumption.

Embodiment 5

Embodiment 5 of the present invention will be described with reference to FIG. 13, FIG. 14 and FIG. 15. Components of Embodiment 5 of the present invention are the same as the components illustrated in FIG. 1, FIG. 6A and FIG. 6B in Embodiment 1. Additionally, a state of a peripheral part of a refrigerating storage compartment during cooling operation in Embodiment 5 is the same as those in Embodiment 1. Hereinafter, components of Embodiment 5 different from the components of Embodiment 1 will be mainly described, and components of Embodiment 5 identical to the components of Embodiment 1 are denoted by the same reference numerals, and description thereof will be omitted.

Figure 13:
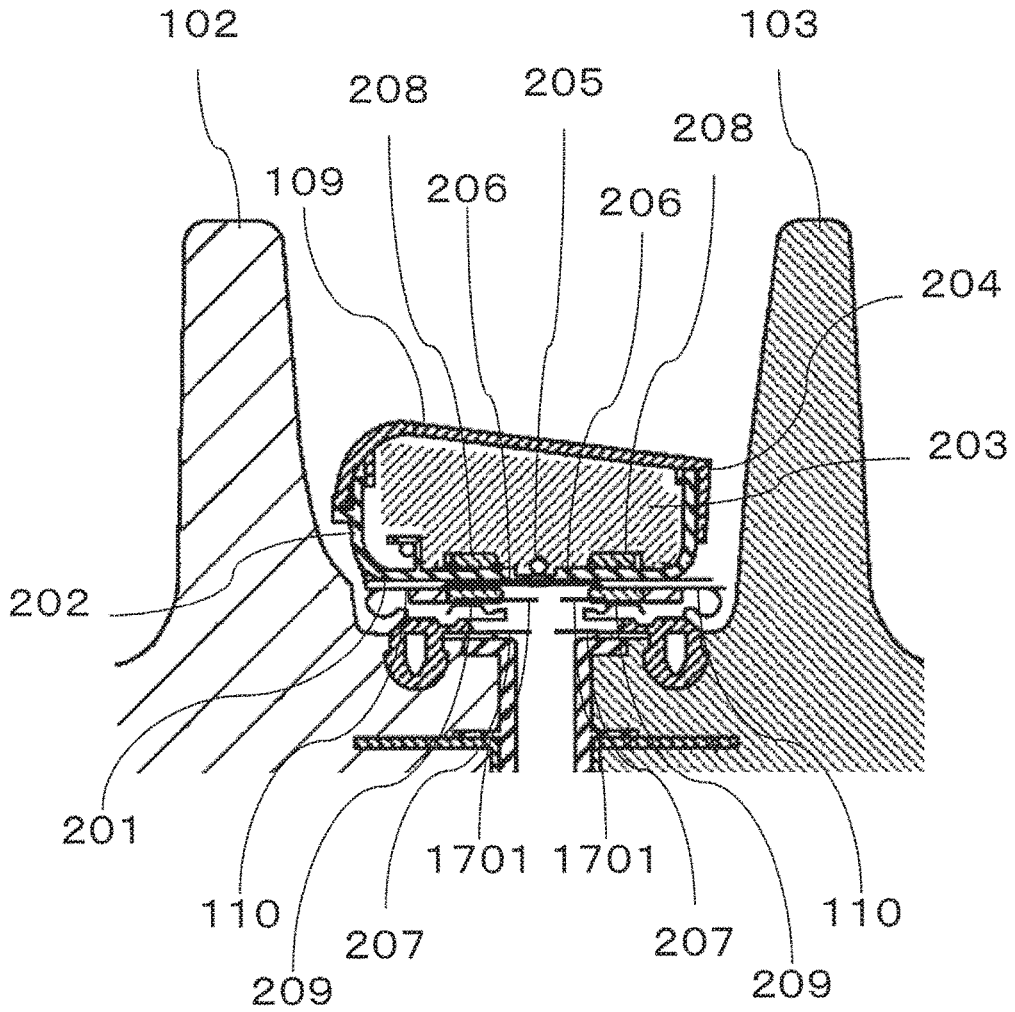
FIG. 13 is an A-A sectional view in FIG. 1 illustrating the state of closing of hinged double doors of a refrigerator according to Embodiment 5 of the present invention.
Figure 14:
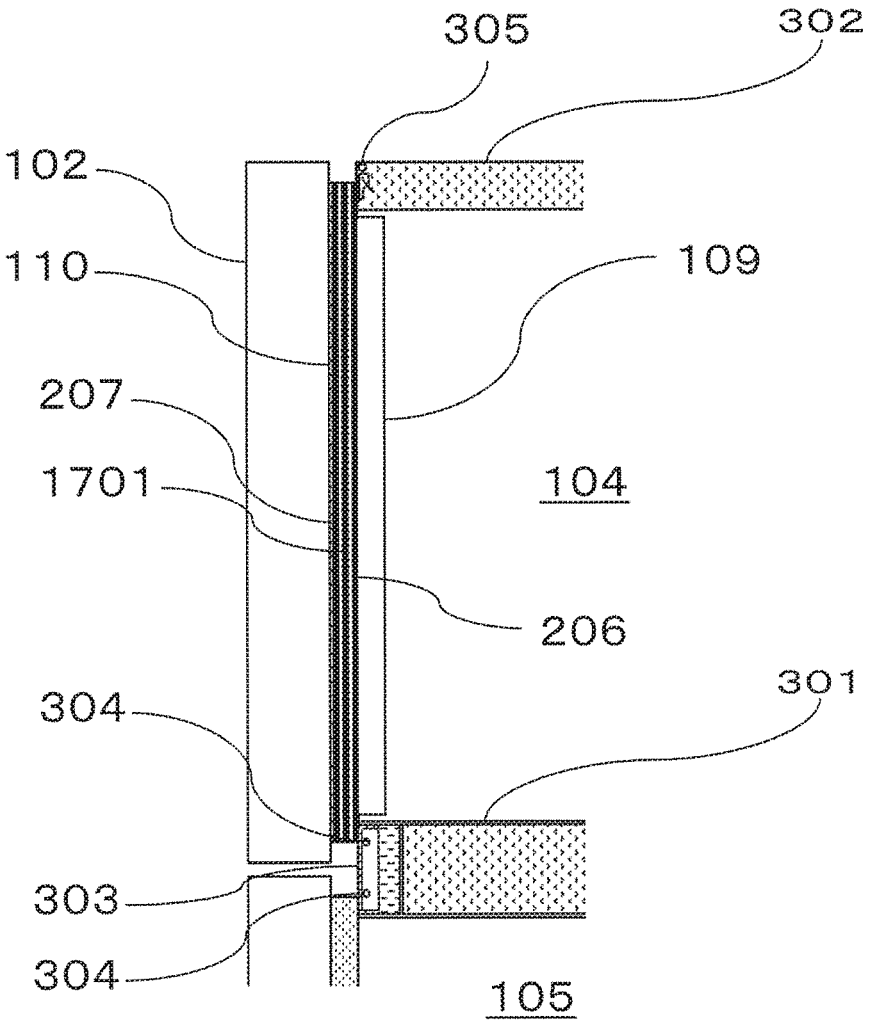
FIG. 14 is a longitudinal sectional view illustrating the state of closing of the hinged double doors of the refrigerator according to Embodiment 5 of the present invention.

FIG. 13 is a horizontal sectional view of hinged double doors according to Embodiment 5 of the present invention, and FIG. 14 is a longitudinal sectional view illustrating the state of closing the hinged double doors of refrigerator 101 according to Embodiment 5 of the present invention. First fin members 206 are disposed in door gaskets 110. Additionally, a plurality of second fin members 207, 1701 are disposed in door gaskets 110.

Figure 15:
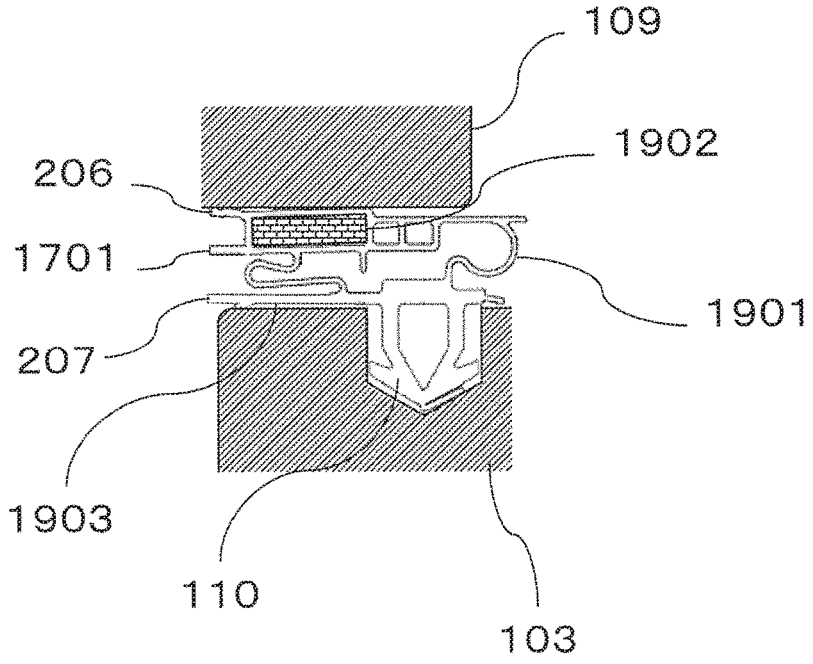
FIG. 15 is a horizontal sectional view of a door gasket according to Embodiment 5 of the present invention.
Figure 16:
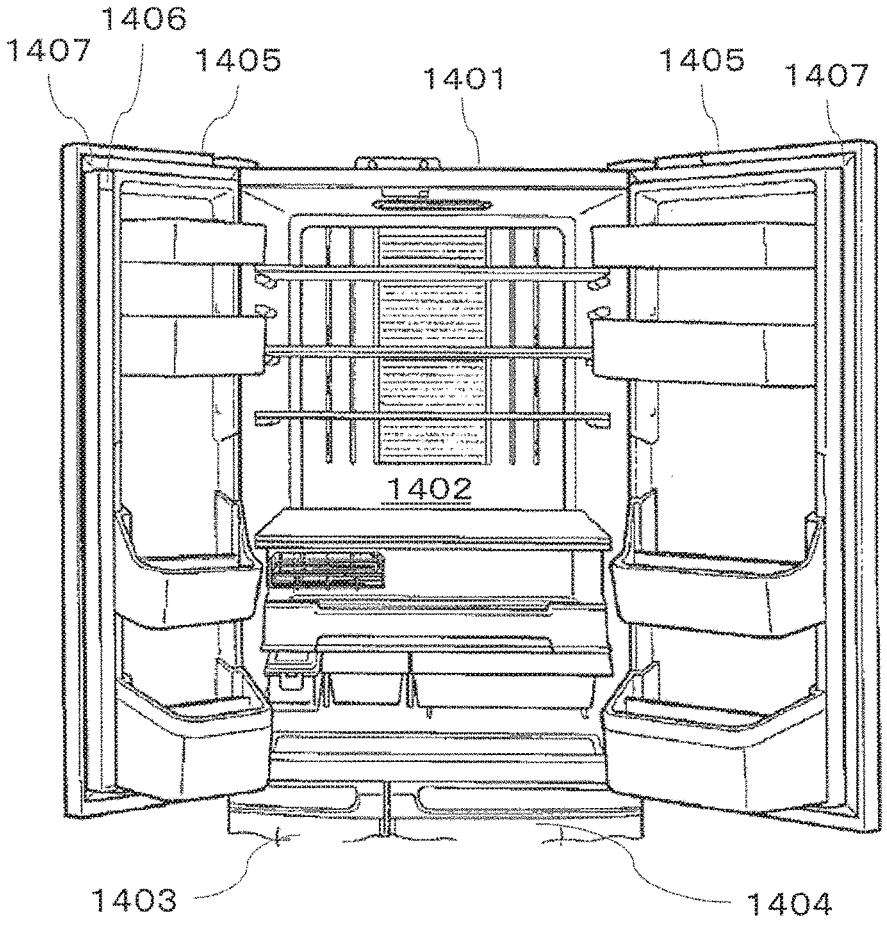
FIG. 16 is a diagram of the periphery of hinged double doors of conventional refrigerator disclosed in Japanese Patent Application Laid-Open No. 2010-249491.
Figure 17:
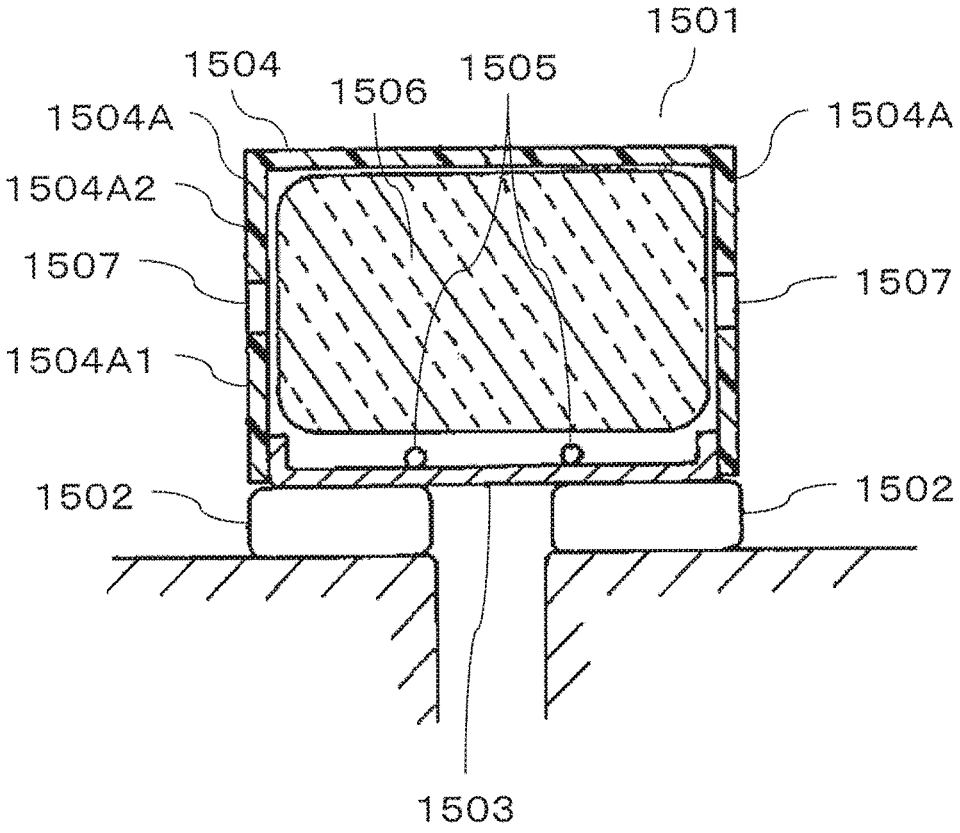
FIG. 17 is a horizontal sectional view of conventional hinged double doors disclosed in Japanese Patent Application Laid-Open No. 2014-134377.
Figure 18:
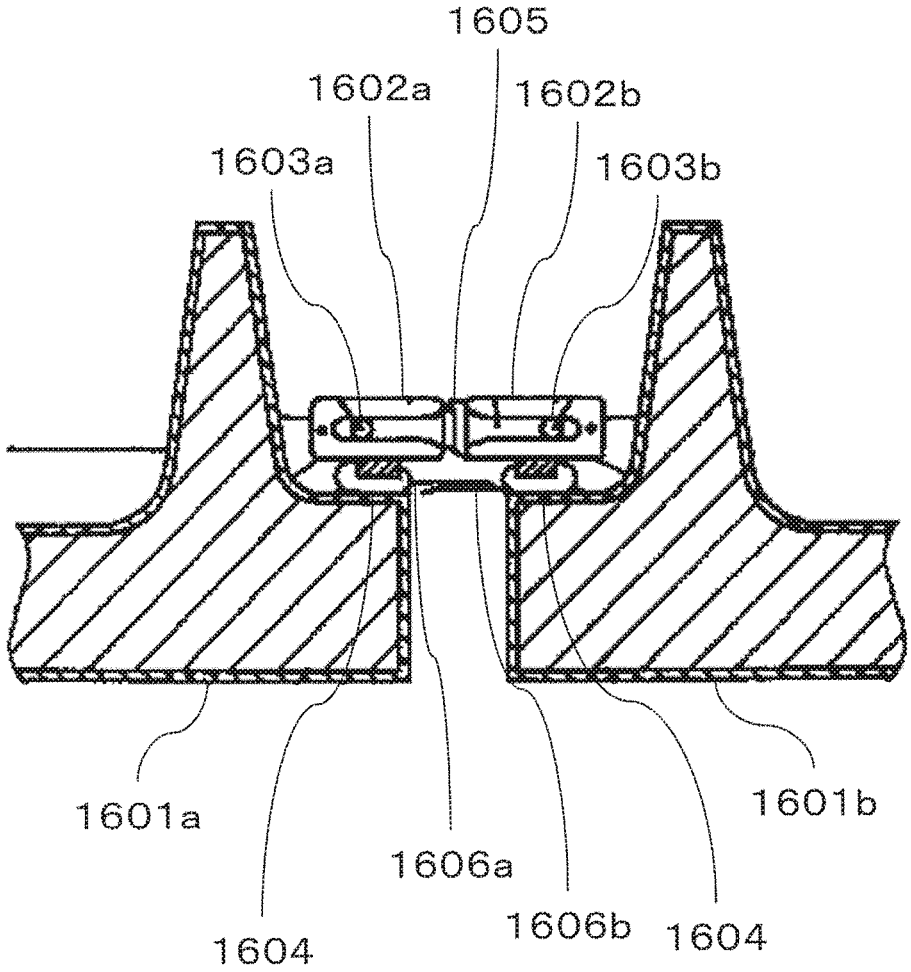
FIG. 18 is a horizontal sectional view of conventional hinged double doors disclosed in Japanese Patent Application Laid-Open No. 2003-114087.

FIG. 15 is a horizontal sectional view of door gasket 110 according to Embodiment 5 of the present invention. First fin members 206 are in contact with rotary partition body 109. Second fin members 207, 1701 are not disposed in thermal insulation layer part 1901 of each of door gaskets 110, but disposed in door-fixing fin part 1903 of each door gasket, and a portion surrounding magnetic substance 1902 disposed in each door gasket, respectively. Consequently, second fin members 207, 1701 are not disposed in thermal insulation layer parts 1901 of door gaskets 110, which are deformed by opening and closing the hinged double doors, but disposed in the portions that are not affected by opening and closing of hinged double doors and are not deformed, so that it is possible to suppress deformation of second fin members 207, 1701 or dislocation in the direction.

As described above, according to this Embodiment 5, thermal insulation is attained by heat insulating sheets 601 disposed in first fin members 206, and a high temperature atmosphere is surrounded by second fin members 207, 1701, so that it is possible to reduce supplying power for heater heating by partition body heating section 205 installed in rotary partition body 109, and it is possible to reduce power consumption.

CONCLUSION

The above embodiments can be freely combined.

INDUSTRIAL APPLICABILITY

A refrigerator of the present invention has capacity of preventing dew condensation by increasing the surface temperature of an outside air contact surface even when supplying power to a heater is reduced, and is applicable to applications of prevention of dew condensation and reduction in power consumption of a thermal insulation box body having a hinged double door structure, and the like.

REFERENCE SIGNS LIST

101 Refrigerator
102 Left door
103 Right door
104 Refrigerating storage compartment
105 Ice-making compartment
106 Freezing storage compartment
107 Vegetable compartment
108 Switching compartment
109 Rotary partition body
110 Door gasket
201 Attraction surface
202 Partition plate
203 Heat insulating material
204 Partition frame body
205 Partition body heating section
206 First fin member
207 Second fin member
207*a* Upper bent part of second fin member
207*b* lower bent part of second fin member
208 Magnetic substance
209 Magnetic substance
301 Division board
302 Refrigerator box body upper wall
303 Division board front surface plate
304 Front surface part heating section
305 Box body upper wall front surface heating section
601 Sheet-like heat insulating material (heat insulating sheet)
701*a* Upper second fin member
701*b* Lower second fin member
1501 Partition body
1502 Gasket
1503 Partition plate
1504 Partition casing
1504A Right and left both side surface parts of partition casing
1504A1 Side surface part front portion of partition casing
1504A2 Side surface part back portion of partition casing
1505 Heater
1506 Heat insulating material
1507 Cutout
1601*a* Left door
1601*b* Right door
1602*a* Partition body
1602*b* Partition body
1603*a* Pin
1603*b* Pin
1604 Gasket
1605 Partition gasket
1606*a* Fin member
1606*b* Fin member
1701 Second fin member
1901 Thermal insulation layer part of door gasket
1902 Magnetic substance disposed in door gasket
1903 Door fixing fin part of door gasket

The invention claimed is:

1. A refrigerator comprising:

a division board that divides a thermal-insulated box body into a plurality of rooms including a refrigerating compartment;

hinged double doors that are located at a front opening of the refrigerating compartment, and are opened and closed right and left;

a rotary partition body that is provided on at least one of inner surfaces of the hinged double doors over a longitudinal direction, and has a partition plate forming an attraction surface;

door gaskets that are located between the rotary partition body and the front opening, and attract the attraction surface; and a thermal-insulated box body front surface heating section that heats a front surface part of the thermal-insulated box body and a front surface of the division board, the refrigerator further comprising:

first fin members disposed in the door gaskets, the first fin members coming into contact with the front surface part of the thermal-insulated box body, the front surface of the division board, and the rotary partition body, the first fin members closing a clearance between the rotary partition body and the front opening of the refrigerating compartment; and second fin members disposed at portions of the door gaskets, the portions being not deformed when the hinged double doors are opened and closed, the second fin members disposed at a clearance between the right and left hinged double doors in front of a front surface of the rotary partition body, the second fin members not coming into contact with the rotary partition body and not coming into contact with each other, wherein the second fin members extend in a horizontal direction in upper parts of the hinged double doors, and extending parts of the second fin members, the extending parts extending to the upper parts of the hinged double doors, are bent toward the front surface part of the thermal-insulated box body.

2. The refrigerator according to claim 1, wherein the portions of the door gasket, the portions not being deformed and being disposed with the second fin members, are portions for fixing the attraction surface, and magnetic substances disposed inside the door gaskets to attract the attraction surface.

3. The refrigerator according to claim 1, wherein the portions of the door gasket, the portions not being deformed and being disposed with the second fin members, are fixation fin parts that fix the door gasket to the hinged double doors in a contact manner.

4. The refrigerator according to claim 1, wherein at least two or more of the second fin members are provided in each of the right and left door gaskets.

5. The refrigerator according to claim 4, wherein at least the two or more of second fin members that are provided in each of the right and left door gaskets do not come into contact with each other.

6. The refrigerator according to claim 1, wherein the second fin members are provided over a whole longitudinal direction of the hinged double doors.

7. The refrigerator according to claim 1, wherein the second fin members are provided so as to be separated on upper end sides and lower end sides of the hinged double doors.

8. The refrigerator according to claim 1, wherein the second fin members are provided on upper end sides of the hinged double doors.

9. The refrigerator according to claim 1, wherein the second fin members are provided on lower end sides of the hinged double doors.

10. The refrigerator according to claim 1, wherein a structure, in which the second fin members are bent, allows contact with the front surface part of the thermal-insulated box body.

11. The refrigerator according to claim 1, wherein sheet-like heat insulating materials are disposed on refrigerator-inside outer surfaces of the first fin members.

12. The refrigerator according to claim 1, wherein sheet-like heat insulating materials are disposed on outside air side outer surfaces of the first fin members.

13. The refrigerator according to claim 1, wherein sheet-like heat insulating materials are disposed inside the first fin members.

14. The refrigerator according to claim 13, wherein the sheet-like heat insulating materials each are a heat insulating sheet obtained by burying silica aerogel in gaps of a fiber sheet.

15. The refrigerator according to claim 1, wherein the rotary partition body further has:

a heat insulating material that is disposed inside the rotary partition body;

a partition frame body that covers a peripheral edge of the partition plate, and an outer surface of the heat insulating material; and a partition plate heating section that heats an inner surface of the partition plate.

16. A refrigerator comprising:

a division board that divides a thermal-insulated box body into a plurality of rooms including a refrigerating compartment;

hinged double doors that are located at a front opening of the refrigerating compartment, and are opened and closed right and left;

a rotary partition body that is provided on at least one of inner surfaces of the hinged double doors over a longitudinal direction, and has a partition plate forming an attraction surface;

door gaskets that are located between the rotary partition body and the front opening, and attract the attraction surface; and a thermal-insulated box body front surface heating section that heats a front surface part of the thermal-insulated box body and a front surface of the division board, the refrigerator further comprising:

first fin members disposed in the door gaskets, the first fin members coming into contact with the front surface part of the thermal-insulated box body, the front surface of the division board, and the rotary partition body, the first fin members closing a clearance between the rotary partition body and the front opening of the refrigerating compartment; and second fin members disposed at portions of the door gaskets, the portions being not deformed when the hinged double doors are opened and closed, the second fin members disposed at a clearance between the right and left hinged double doors in front of a front surface of the rotary partition body, the second fin members not coming into contact with the rotary partition body and not coming into contact with each other, wherein the second fin members extend in a horizontal direction in upper parts of the hinged double doors, and extending parts of the second fin member, the extending parts extending to the lower parts of the hinged double doors, are bent toward the front surface of the division board.

17. The refrigerator according to claim 16, wherein the bent structures of the second fin members allow contact with the front surface of the division board.

* * * * *